US008605936B2

(12) United States Patent
Proni

(10) Patent No.: US 8,605,936 B2
(45) Date of Patent: Dec. 10, 2013

(54) IN-WALL LOUDSPEAKER MOUNTING METHOD AND APPARATUS

(75) Inventor: Lucio Proni, Weston, FL (US)

(73) Assignee: JL Audio, Inc., Miramar, FL (US)

( * ) Notice: Subject to any disclaimer, the term of this patent is extended or adjusted under 35 U.S.C. 154(b) by 232 days.

(21) Appl. No.: 12/883,748

(22) Filed: Sep. 16, 2010

(65) Prior Publication Data

US 2012/0070025 A1 Mar. 22, 2012

(51) Int. Cl.
*H04R 1/02* (2006.01)

(52) U.S. Cl.
USPC ..... 381/386; 381/87; 381/332; 381/150; 381/152; 181/148; 181/150

(58) Field of Classification Search
USPC ..... 381/392, 71.3, 71.4, 87, 152, 164, 301, 381/302, 332–334, 345, 353, 354, 386–389, 381/395; 181/148–151, 296
See application file for complete search history.

(56) References Cited

U.S. PATENT DOCUMENTS

| | | | | |
|---|---|---|---|---|
| 2,457,029 | A | 12/1948 | Brockway | |
| 4,296,280 | A | 10/1981 | Richie | |
| 4,433,749 | A | 2/1984 | Watkins et al. | |
| 4,903,300 | A | 2/1990 | Polk | |
| 5,368,270 | A * | 11/1994 | Wiwczar | 248/610 |
| 6,015,025 | A | 1/2000 | McGrath et al. | |
| 6,098,743 | A | 8/2000 | McGrath | |
| 6,357,717 | B1 * | 3/2002 | Kennard, IV | 248/638 |
| 6,360,842 | B1 | 3/2002 | Combest | |
| 6,367,579 | B1 | 4/2002 | Wiener | |
| 6,550,570 | B2 | 4/2003 | Combest | |
| 6,609,589 | B2 | 8/2003 | Combest | |
| 6,741,720 | B1 | 5/2004 | Myatt | |
| 7,221,772 | B2 * | 5/2007 | Evenisse et al. | 381/386 |
| 7,292,702 | B2 | 11/2007 | Hagman | |
| 7,353,907 | B2 | 4/2008 | Whitaker | |
| 7,503,422 | B2 | 3/2009 | Combest et al. | |
| 7,530,425 | B2 | 5/2009 | Whitaker | |
| 7,636,447 | B2 | 12/2009 | Saint-Vincent et al. | |
| 2003/0123679 | A1 | 7/2003 | Dudleston et al. | |
| 2008/0080727 | A1 | 4/2008 | Prenta et al. | |
| 2008/0085029 | A1 | 4/2008 | Hagman | |
| 2009/0103758 | A1 | 4/2009 | Maeshiba | |
| 2010/0215204 | A1 * | 8/2010 | Castro et al. | 381/386 |

OTHER PUBLICATIONS

Genelec 5041A "Active In-Wall Subwoofer" Operating Manual; Genelec Document D0079R001 Copyright Genelec Oy Sep. 2008.

* cited by examiner

*Primary Examiner* — Brian Ensey
*Assistant Examiner* — Sabrina Diaz
(74) *Attorney, Agent, or Firm* — GrayRobinson, PA

(57) ABSTRACT

A method and apparatus for mounting a loudspeaker within a cavity in the wall of a room to lessen the transmission of vibration to the wall comprises a weight support member coupled to the speaker cabinet and at least one flexible member extending from the speaker cabinet into engagement with wallboard or other wall sections forming opposite sides of the wall.

35 Claims, 4 Drawing Sheets

IN-WALL LOUDSPEAKER MOUNTING METHOD AND APPARATUS

FIELD OF THE INVENTION

This invention relates to home theater systems, and, more particularly, to a method and apparatus for mounting loudspeakers in the wall of the room of the home theater in such a way as to minimize the transmission of vibration resulting from operation of the speaker to the surrounding wall and room.

BACKGROUND OF THE INVENTION

High-end home theaters typically include a large screen high definition television with a sound system that incorporates subwoofer loudspeakers. Stand alone high performance subwoofers may include an in-built amplifier and more than one driver which collectively require a cabinet or enclosure that is relatively large in size. Many owners of home theaters are reluctant to incorporate subwoofers of this type into their sound system for aesthetic reasons and because they take up so much space.

One solution to this problem has been the development of in-wall subwoofers which are mounted within a cavity formed in the wall of the home theater room. The cavity is defined by the space between two adjacent studs which extend between a top plate at the ceiling of the room and a bottom plate along the floor. The cavity is closed by wallboard on either side of the studs, with only a small grill area where the speaker driver is located showing in the room.

Traditionally, in-wall subwoofers and other speakers are mounted in the wall cavity using brackets, screws or other means of attachment which connect the speaker cabinet directly to the studs and/or to the top and bottom plates. See, for example, U.S. Pat. Nos. 4,296,280; 4,903,300; 6,098,743; 6,550,570; 6,360,842; 7,292,702 and 7,503,422. Mounting of the speaker cabinet in this fashion creates a very rigid connection to the wall structure, which allows vibration from the speaker to be directly transferred to the wall. Wall vibrations can adversely affect the sound output from the speaker, and cause noisy rattling from any items attached to the wall such as pictures, shelves and the like.

In addition to the rigid form of connection noted above, vibration can occur in prior in-wall speaker mounting systems due to the size of the speaker itself. Traditional loudspeaker cabinets have a depth dimension which is nearly the same as the width of the wall studs. As a result, the speaker driver is located very close to the wallboard forming the front and back of the wall. If the front or back of the speaker cabinet touches the wallboard, rattles and buzzes may be created while music or a movie is being played due to vibration transfer. Any noises of this sort during playback are particularly annoying to the home theater owner and can lead to extensive follow-up work for the installer.

SUMMARY OF THE INVENTION

This invention is directed to a method and apparatus for mounting a loudspeaker system within a wall cavity of a room in such as way that vibration transfer to the wall and surrounding room is substantially reduced.

In the presently preferred embodiment, a loudspeaker system having a speaker cabinet is located within the wall cavity by a weight support member that extends between the top or bottom plate of the cavity and the speaker cabinet. The weight support member may take the form of a tension device such as a rod, rope, cable, spring, cord, bungee cord, rubber band or the like connected between the top plate and the speaker cabinet so that the loudspeaker is suspended within the cavity out of contact with the wall studs, top plate and bottom plate. Alternatively, the loudspeaker may be supported by one or more compression devices connected to the bottom plate in position for the speaker cabinet to rest atop such device and out of contact with the studs and plates defining the cavity.

In addition to the weight support member, the apparatus of this invention includes a flexible member extending from the speaker cabinet into engagement with the wallboard or other wall section that encloses the cavity. The flexible member may take the form of a number of flexible pads, such as foam pads, that are located at different points along both the front wall and the back wall of the speaker cabinet. The flexible pads not only substantially reduce the transmission of vibration from the loudspeaker to the surrounding wall but stabilize the speaker cabinet within the cavity in the side-to-side and front-to-back directions, e.g. in a direction between the studs and in a direction between the sections of wallboard or other wall structure.

The combination of the weight support member and flexible member limits the transmission of vibration from the loudspeaker system to the surrounding room via the wall structure, e.g. the studs, top plate, bottom plate and wallboard or other wall section that encloses the wall cavity. No rigid connection is created between the speaker cabinet and studs or plates, but, instead, stabilization of the speaker cabinet and reduction of vibration transmission is achieved by a controlled interaction between the flexible member and the wallboard or other wall structure.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
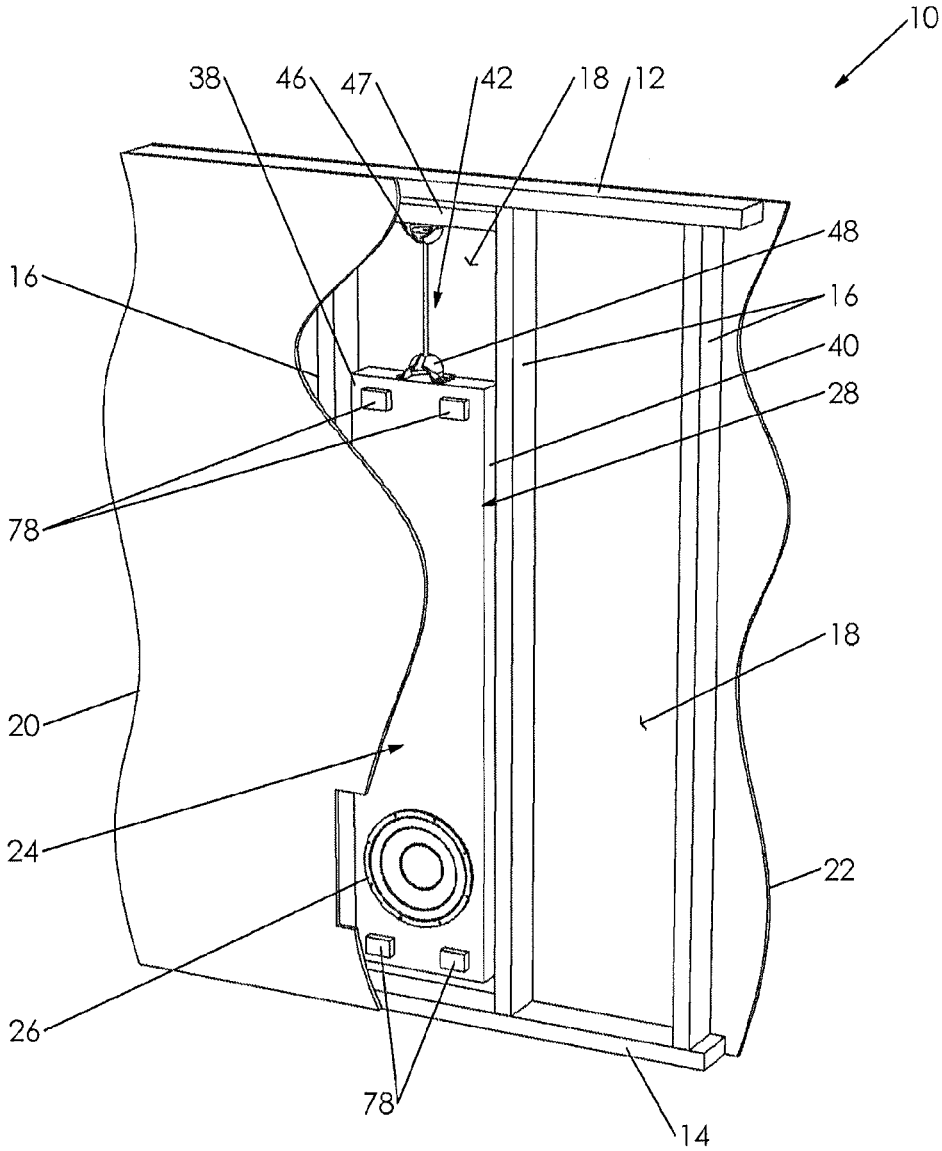
FIG. 1 is a perspective view of a loudspeaker system located within the cavity of a wall structure by the in-wall mounting apparatus of this invention.
Figure 2:
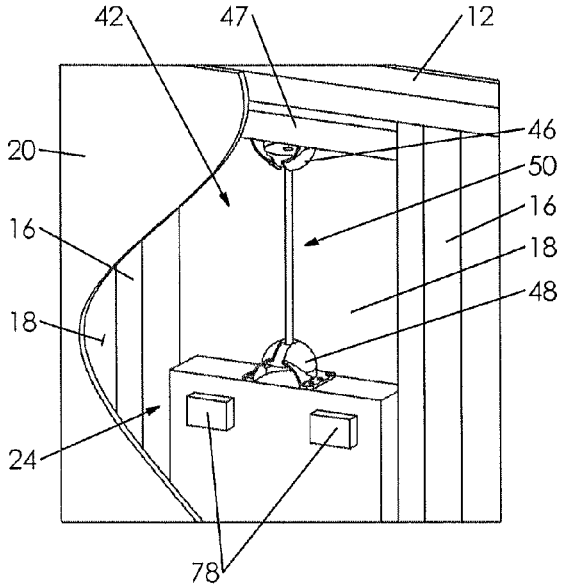
FIG. 2 is a partial perspective view of the upper portion of the loudspeaker system depicting one embodiment of a weight support member.

Referring initially to FIG. 1, a portion of a wall 10 forming part of a room for a home theater or other entertainment room is schematically depicted. The wall 10 may be formed by a top plate 12, a bottom plate 14 and a number of spaced studs 16 each extending between the top and bottom plates 12, 14. The studs 16, and top and bottom plates 12, 14, define a number of cavities 18 along the length of the wall 10, e.g. each cavity 18 is located between a pair of adjacent studs 16 and that portion of the top plate 12 and bottom plate 14 positioned between such studs 16.

In the embodiment illustrated in FIG. 1, the cavities 18 are enclosed by a wall section in the form of a first sheet 20 of wallboard affixed to one side of the studs 16, top plate 12 and bottom plate 14, and a second sheet 22 of wallboard affixed to the opposite side thereof. It should be understood that the wall sections herein may be formed of other materials such a paneling etc. Further, the studs 16 and top and bottom plates 12, 14 may abut an existing wall of the building within which the home theater is located, such as an outside wall formed of concrete, brick or other materials, in which case only one sheet of wallboard or other material would be affixed to one side of the studs 16, top plate 12 and bottom plate 14 in order to enclose the cavities 18. Consequently, the term "wall section" as used herein is meant to broadly refer to essentially any structure that encloses the cavities 18.

One of the cavities 18 receives a loudspeaker system 24 which is mounted in place according to the method and apparatus of this invention. As best seen in FIGS. 1 and 7-9, the loudspeaker system 24 comprises a transducer or driver 26 which is housed within a speaker cabinet 28 having a front wall 30, a back wall 32, a top wall 34, a bottom wall 36 and opposed end walls 38, 40. The term "speaker cabinet" is often referred to in the art as a speaker "box" or "enclosure" and all three terms are intended to refer to the same structure. The driver 26 forms no part of this invention and is therefore not discussed in detail. Preferably, the driver 26 is of the type described in U.S. Pat. Nos. 5,734,132 and 6,095,280, the disclosures of which are hereby incorporated by reference in their entireties herein. Drivers 26 of this type have a "shallow" construction, e.g. the depth or front-to-back dimension of driver 26 is appreciably less than the width of a stud 16, or of top and bottom plates 12, 14, as discussed in more detail below. While the driver 26 depicted in the Figs. and described in the patents noted above is for a subwoofer, it is contemplated that other loudspeaker systems could be employed with the mounting method and apparatus of this invention such as satellite speakers having inherently smaller drivers and systems employing multiple drivers such as one or more subwoofers, mid-range and tweeter drivers (not shown).

The loudspeaker system 24 is mounted within a cavity 18 by a weight support member 42. As best seen at the top of FIG. 1, and in FIGS. 2-5, the weight support member 42 may take the form of first bracket 46 mounted to a cross member 47, a second bracket 48 mounted to the top wall 34 of the speaker cabinet 28 and a rod assembly 50 connected between the first and second brackets 46, 48. In the presently preferred embodiment, each of the first and second brackets 46, 48 have the same construction and comprise an end plate 52 formed with a number of spaced holes 54, which is connected to or integrally formed with a cup-shaped seat 56. A slot 57 is formed in both the end plate 52 and seat 56 to permit insertion of the rod assembly 50, as discussed below. Each of the first and second brackets 46, 48 may be affixed to the top plate 12 and speaker cabinet 28, respectively, by screws or other fasteners.

Figure 3:
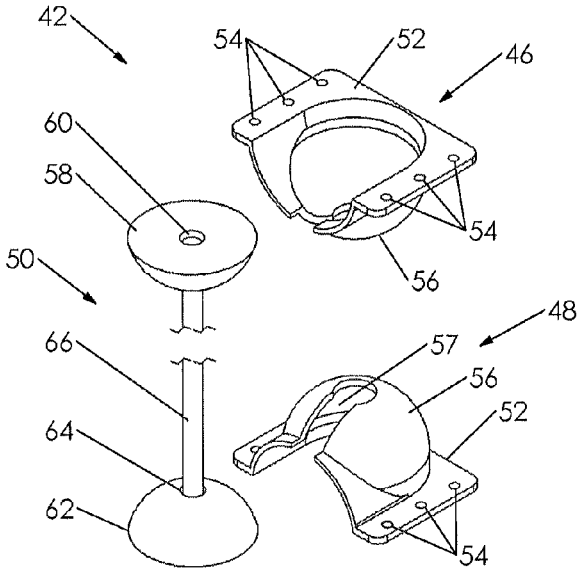
FIG. 3 is an exploded perspective view of the weight support member shown in FIG. 2.

The rod assembly 50 comprises a first body 58 having a through bore that mounts a threaded insert 60, a second body 62 having a through bore that receives a threaded insert 64 and a rod 66 with threaded ends that are secured within the inserts 60, 64 of respective first and second bodies 58, 62. Preferably, each of the first and second bodies 58, 62 are formed of a resilient material, such as rubber, and are shaped to mate with the cup-shaped seat 56 in respective first and second brackets 46, 48. As indicated in FIG. 3, the rod 66 passes through the slot 57 formed in each bracket 46, 48 so that the first and second bodies 58, 62 may be received within respective seats 56.

It is noted that the first bracket 46 is coupled to a cross member 47 instead of directly to the top plate 12. The cross member 47 is mounted at its ends to adjacent studs 16, and may be employed in homes where the ceiling height is in excess of the design height of the loudspeaker system 24. Use of the cross member 47 avoids the necessity of providing a rod assembly 50 with rods 66 of different length since a height adjustment can be accomplished by the use of a cross member 47 positioned at essentially any location along the length of the studs 16. For purposes of the present discussion, the term "top plate" is meant to broadly refer to the top plate 12 of the wall 10 and any cross member 47 that may be employed depending on the height of wall 10.

Figure 4:
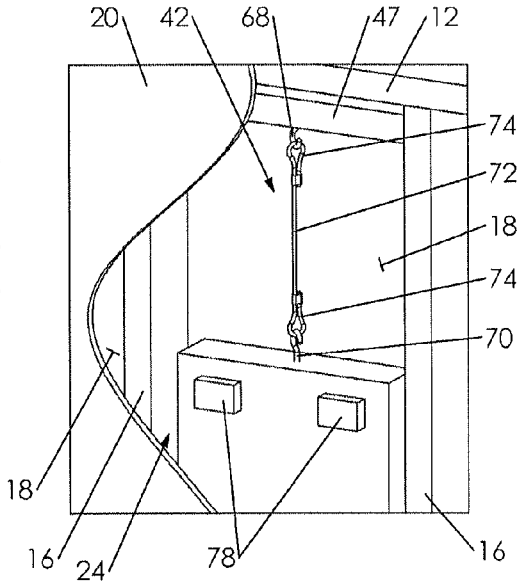
FIG. 4 is a perspective view similar to FIG. 2 except of an alternative embodiment of a weight support member according to this invention.
Figure 5:
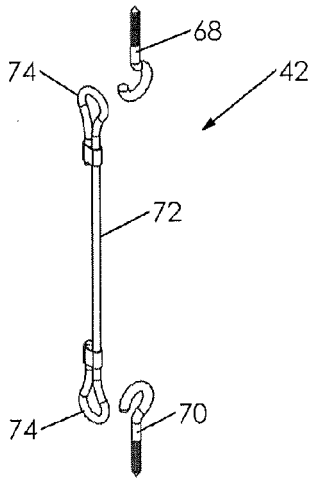
FIG. 5 is an exploded perspective view of the weight support member shown in FIG. 4.

In an alternative embodiment shown in FIGS. 4 and 5, the brackets 46, 48 are replaced by hooks 68 and 70 mounted to the cross member 47 (or top plate 12) and to the speaker cabinet 28, respectively, and the rod assembly 50 is replaced by a cable 72. Each end of the cable 72 is formed with a loop 74 which may be coupled to a hook 68 or 70. It should be understood that instead of a cable 72 other supports may be employed such as rope, springs, cords, bungee cords, rubber bands and the like.

Figure 6:
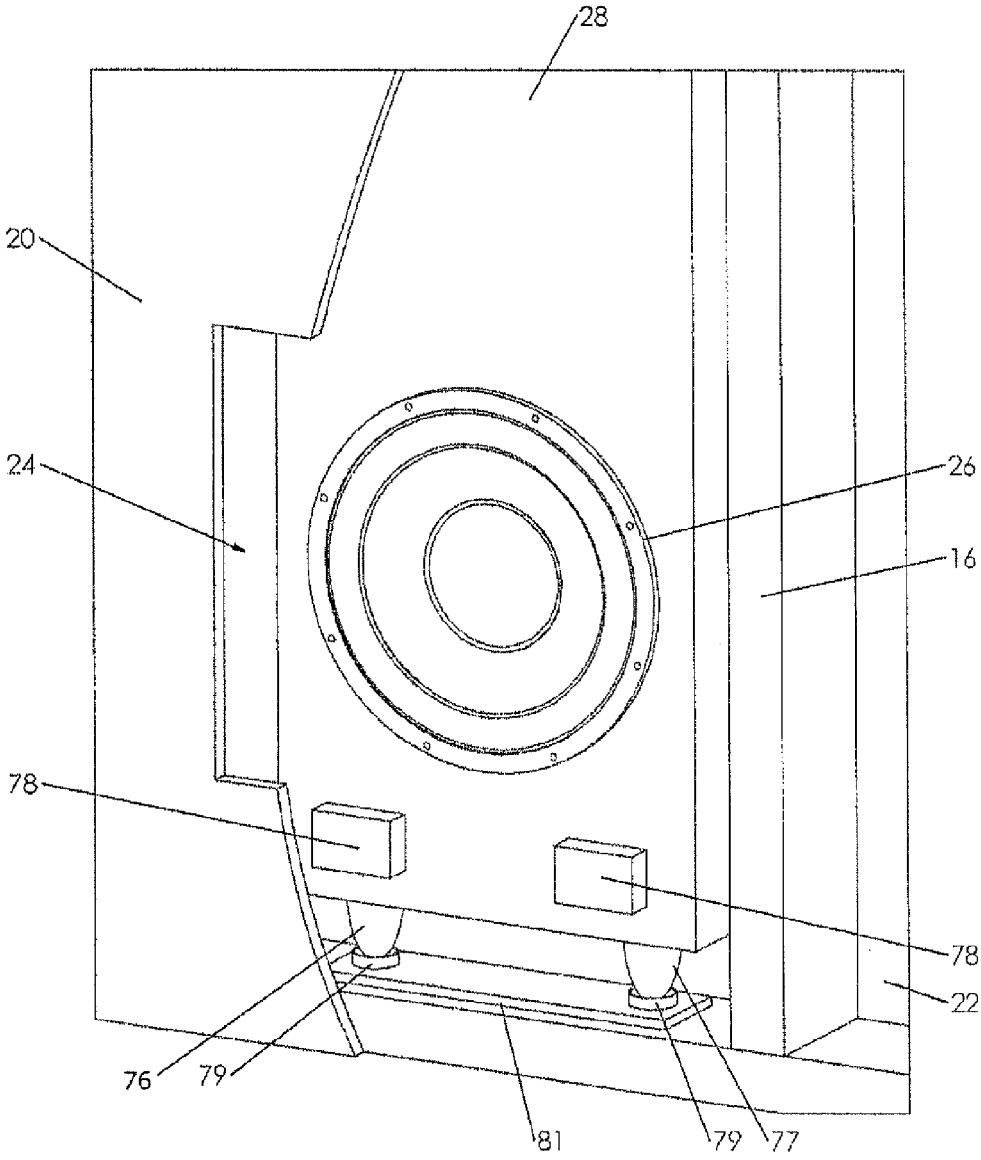
FIG. 6 is a view similar to FIG. 2 except of a further embodiment of the weight support member mounted to the bottom wall of the speaker cabinet.

The rod assembly 50 and cable 72 may be characterized as "tension members" in the sense that they support the weight of the loudspeaker system 24 within a cavity 18 by undergoing a tensile force. It is contemplated that the weight of the loudspeaker system 24 may alternatively be supported by a compression member, such as a body of resilient material or similar support structures located between the bottom plate 14 and the bottom wall 36 of the speaker cabinet 28. One embodiment of a compression member is schematically illustrated in FIG. 6 comprising a pair of spaced legs 76 and 77 extending from the bottom wall of the speaker cabinet 28 which are received within respective cups 79 of rubber or similar material capable of resiliently supporting the weight of loudspeaker system 24. The legs 76, 77 may be rigid or formed of a flexible material, and other resilient structures such as springs and the like may be employed that undergo compression in order to support the weight of loudspeaker system 24 within a cavity 18, with or without the use of cups 79. In one embodiment, the cups 79 may be mounted to a support plate 81 or directly to the bottom plate 14 of the wall 10. While the support plate 81 is shown in FIG. 6 as resting directly atop the bottom plate 14, it should be understood that the support plate 81 could be located at essentially any position along the cavity 18 and for purposes of the present discussion the term "bottom plate" is meant to broadly refer to the bottom plate 14 of the wall 10 and any support plate 81 that may be employed.

Figure 7:
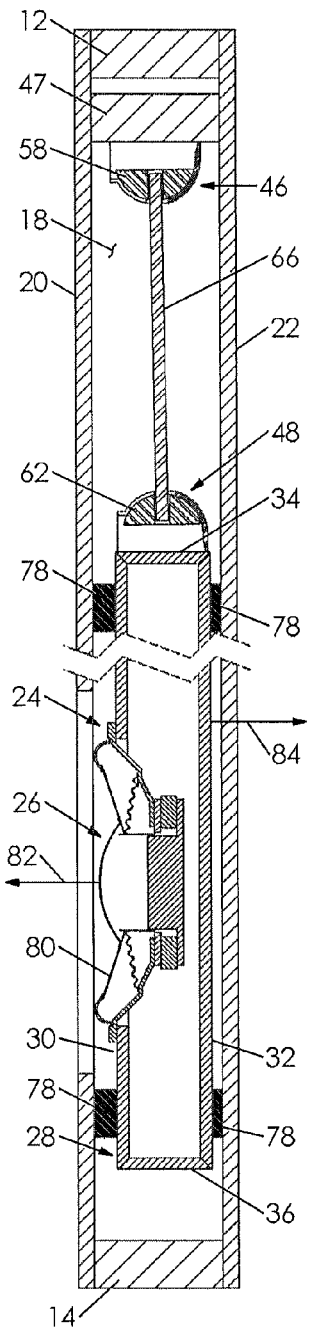
FIG. 7 is a cross section view of a loudspeaker system located within a wall cavity and being supported by the weight support member of FIG. 2 illustrating the reaction of flexible members in the form of foam pads to the speaker cabinet in response to movement of the speaker driver in one direction.
Figure 8:
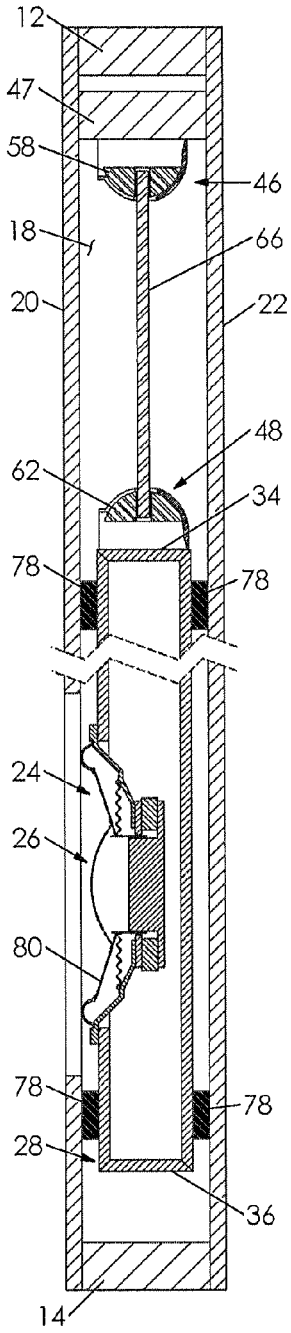
FIG. 8 is a view similar to FIG. 7 except with the speaker driver in a neutral position with no excursion toward the front or back of the cavity.
Figure 9:
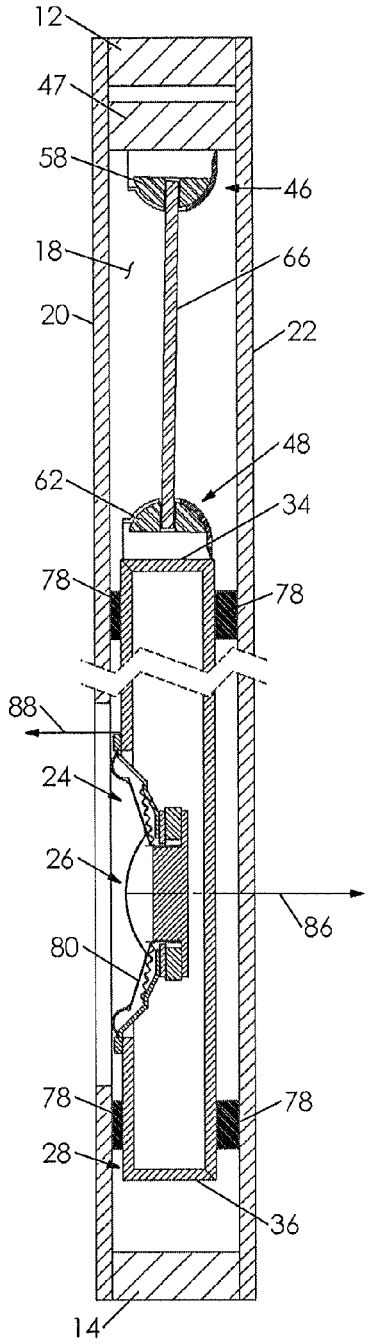
FIG. 9 is a view similar to FIG. 7 except depicting excursion of the speaker driver in the opposite direction.

In addition to the weight supporting member 42, the loudspeaker system 24 may be secured within cavity 18 by at least one flexible member. In one presently preferred embodiment, the flexible member comprises a number of pads 78 each formed of a section of flexible material such foam, rubber or the like. Several pads 78 may be mounted to the front wall 30 of the speaker cabinet 28, and several other pads 78 may be mounted to its back wall 32. As best seen in FIGS. 7-9, each pad 78 extends from the speaker cabinet 28 into engagement with a wall section, e.g. one of the first or second sheets 20, 22 of wallboard in the embodiment depicted in FIG. 1.

Preferably, although not necessarily, each of the front wall 30 and back wall 32 of the speaker cabinet 28 mounts a total of four pads 78, e.g. two pads 78 near the top wall 34 of the speaker cabinet 28 which are spaced from one another but extend inwardly from the end walls 38, 40, and two pads 78 near the bottom wall 36 of the speaker cabinet 28 which substantially align with the other two pads 78. In the configuration depicted in the Figs., the pads 78 are generally rectangular in shape with a length of about 76.2 mm, a width of about 38.1 mm and a thickness of about 10 mm thick. The exact positioning of the pads 78 on the speaker cabinet 28 may vary with the cabinet height, but in one presently preferred embodiment, two pads 78 are spaced about 203.2 mm from the top wall 34 of the speaker cabinet 28 on both the front and back walls 30, 32, and two pads 78 are spaced about 3.2 mm from the bottom wall 36 on the front and back walls 30, 32. Further, all pads 78 are preferably spaced approximately 25.4 mm from one of the end walls 38 or 40 of the speaker cabinet 28, and the spacing between aligning pads 78 at both the top and bottom the speaker cabinet 28 is about 298.5 mm measured from their edges closest to the end walls 38, 40. Additionally, each of the pads 78 is preferably formed of a closed cell foam.

The pads 78 forming the flexible member of this invention perform at least two functions. First, because pads 78 engage the sheets 20, 22 or wall sections of the wall 10, the pads 78 stabilize the loudspeaker system 24 within the cavity 18 in the side-to-side direction and the front-to-back direction. For purposes of discussion, the "side-to-side" direction is meant to refer to a direction between adjacent studs 16, and the "front-to-back" direction refers to a direction between the first and section sheets 20, 22 forming the wall sections of wall 10.

A second function of the pads 78 is to dampen vibration produced by operation of the driver 26 of loudspeaker system 24. Referring to FIGS. 7-9, a side view of the loudspeaker system 24 mounted within a cavity 18 is depicted. As noted above, the depth of the loudspeaker system 24 is appreciably less than the width of the top and bottom plates 12, 14 (and the studs 16 not shown). This provides sufficient space between the front and back walls 30, 32 of the speaker cabinet 28 to permit insertion of the pads 78. In a "neutral" position shown in FIG. 8, e.g. with the driver 26 not operating, the pads 78 mounted to the front wall 30 and the back wall 32 of the speaker cabinet 28 are compressed against respective first and second sheets 20, 22 to the same extent, i.e. the pads 78 undergo compression when the speaker cabinet 28 is positioned within the cavity 18. In response to excursion of the diaphragm 80 of driver 26 in the direction of arrow 82 in FIG. 7, the speaker cabinet 28 moves in the opposite direction depicted by the arrow 84. This motion causes the pads 78 located on the front wall 30 of speaker cabinet 28 to expand and the pads 78 on the opposite, back wall 32 of the speaker cabinet 78 to compress to a greater extent than in the "neutral" position depicted in FIG. 8. Excursion of the driver 26 in the opposite direction, indicated by arrow 86 in FIG. 9, moves the speaker cabinet 28 in the direction of arrow 88 thus causing the pads 78 on the front wall 30 of the speaker cabinet 28 to further compress and the pads 78 on the back wall 32 to extend.

The pads 78 are sufficiently resilient or lossy such that motion and vibration of the speaker cabinet 28 resulting from excursion of the driver 26 and the sound it produces are substantially absorbed within the pads 78 and not transferred to the first and second sheets 20, 22 (or other wall sections), to the studs 16 or to the top and bottom plates 12, 14. Further, the resilient connection between the speaker cabinet 28 and top or bottom plates 12, 14 provided by the weight support members 42, as described above, contributes to the limited transfer of vibration from the loudspeaker system 24 to the wall 10.

While the invention has been described with reference to a preferred embodiment, it should be understood by those skilled in the art that various changes may be made and equivalents substituted for elements thereof without departing from the scope of the invention. In addition, many modifications may be made to adapt a particular situation or material to the teachings of the invention without departing from the essential scope thereof.

For example, the pads 78 illustrated in the Figs. and discussed above may be modified and still be considered within the scope of this invention. The pads 78 may be formed in different sizes and shapes (circular, oval, square etc), and may be located at positions along the front wall 30 and/or back wall 32 of the speaker cabinet 28 other than those illustrated in the Figs. Alternatively, each of the pads may be formed as an elongated section of flexible material with one pad located adjacent to the top wall 34, for example, and another pad located adjacent to the bottom wall 36 of the speaker cabinet 28 instead of the discrete sections of material spaced from one another as shown in the Figs. and described above. Further, instead of pads 78, a continuous band or section of flexible material, such as foam or the like, may be wrapped around the exterior of speaker cabinet 28 at one or more locations along the height of the speaker cabinet 28, e.g. between the top wall 34 and the bottom wall 36. Accordingly, for purposes of the present discussion, the term "at least one flexible member" is meant to refer to all of these alternative constructions, i.e. wherein at least one discrete pad is located on front wall 20 of the speaker cabinet and at least one other discrete pad is located on the back wall 22 thereof, or, wherein a continuous pad is wrapped around the exterior of the speaker cabinet 28 in contact with both the front and back walls 20, 22. In each case, the pads or other flexible member extend from the speaker cabinet 28 into engagement with the first sheet 20 and from the speaker cabinet 28 into engagement with the second sheet 22 or other wall sections that enclose the cavities 18.

Additionally, the weight support member 42 shown in the Figs. is depicted as a rod assembly 50 with a single rod 66 or a single cable 72 or similar support such as a rope, springs, cords, bungee cords, rubber bands and the like. It should be understood that multiple weight support members 42 could be employed and are considered within the scope of this invention.

Therefore, it is intended that the invention not be limited to the particular embodiment disclosed as the best mode contemplated for carrying out this invention, but that the invention will include all embodiments falling within the scope of the appended claims.

I claim:

1. Apparatus for mounting a loudspeaker system having a speaker cabinet within a cavity in the wall of a room defined by spaced first and second studs each extending between a top plate and a bottom plate, said cavity being enclosed by a first wall section located on one side of the first and second studs and a second wall section located on the opposite side of the first and second studs, said apparatus comprising:

a weight support member including a first bracket mounted to the top plate, a second bracket mounted to the speaker cabinet and a rod having a first resilient body connected at one end and a second resilient body connected at its opposite end, said first resilient body being coupled to said first bracket and said second resilient body being coupled to said second bracket;

at least one flexible member extending from the speaker cabinet into engagement with the first wall section and into engagement with the second wall section, said at least one flexible member being effective to reduce transmission of vibration from the speaker cabinet to the first and second wall sections and to stabilize the position of the speaker cabinet within the cavity from movement in a direction between the first and second studs and in a direction between the first and second wall sections.

2. The apparatus of claim 1 in which said weight support member comprises a tension device connected between the top plate and the speaker cabinet.

3. The apparatus of claim 2 in which said tension device is chosen from the group consisting of a rod, spring, rope, cable, cord, bungee cord and rubber band.

4. The apparatus of claim 1 in which said weight support member is a compression device connected between the bottom plate and the speaker cabinet.

5. The apparatus of claim 1 in which said at least one flexible member comprises at least one first flexible pad mounted to one side of said speaker cabinet and at least one second flexible pad mounted to the opposite side of said speaker cabinet.

6. The apparatus of claim 5 in which said at least one first flexible pad comprises a number of first flexible pads mounted at spaced locations to said one side of said speaker cabinet, and said at least one second flexible pad comprises a number of second flexible pads mounted at spaced locations to said opposite side of said speaker cabinet.

7. The apparatus of claim 5 in which each of said at least one first and second flexible pads is formed of a foam material.

8. The apparatus of claim 5 in which said at least one first flexible pad and said at least one second flexible pad undergo initial compression upon installation of the loudspeaker system within the cavity in the wall of the room.

9. The apparatus of claim 8 in which the loudspeaker system includes a driver mounted within the speaker cabinet which undergoes excursion during operation, said at least one first flexible pad undergoing further compression in response to excursion of the driver in a first direction and said at least one second flexible pad being extended in response to excursion of the driver in said first direction.

10. The apparatus of claim 8 in which said at least one first flexible pad is extended in response to excursion of the driver in a second direction, opposite to said first direction, and said at least one second flexible pad undergoes further compression in response to excursion of the driver in said second direction.

11. The apparatus of claim 1 in which the loudspeaker system is positioned within the cavity such that the speaker cabinet does not contact the first stud, the second stud, the top plate or the bottom plate.

12. The method of reducing the transmission of vibration from a loudspeaker system to the wall of a room, comprising:

(a) disposing a weight support member within a cavity formed in the wall which is defined by spaced first and second studs each extending between a top plate and a bottom plate, the cavity being enclosed by a first wall section located on one side of the first and second studs and a second wall section located on the opposite side of the first and second studs;

(b) coupling a first bracket of the weight support member to, the top plate, coupling a second bracket of the weight support member to system, and connecting a first resilient body mounted at one end of a rod to the first bracket and a second resilient body mounted at the opposite end of the rod to the second bracket;

(c) affixing at least one flexible member to the speaker cabinet in position to engage the first wall section and in a position to engage the second wall section such that said at least one flexible member is effective to reduce transmission of vibration from the speaker cabinet to the first and second wall sections and such that said at least one flexible member stabilizes the position of the speaker cabinet within the cavity from movement in a direction between the first and second studs and in a direction between the first and second wall sections.

13. The method of claim 12 in which step (b) comprises suspending the loudspeaker system within the cavity by a tension device connected between the top plate and the speaker cabinet.

14. The method of claim 12 in which step (b) comprises supporting the loudspeaker system within the cavity by a compression device connected between the bottom plate and the speaker cabinet.

15. The method of claim 12 in which step (c) comprises affixing at least one first flexible pad to one side of the speaker cabinet and affixing at least one second flexible pad to the opposite side of the speaker cabinet.

16. The method of claim 15 in which step (c) comprises affixing said at least one first flexible pad and said at least one second flexible pad such that they undergo initial compression upon installation of the loudspeaker system within the cavity of the wall of the room.

17. The method of claim 16 in which step (c) comprises affixing at least one first flexible pad to one side of the speaker cabinet and affixing at least one second flexible pad to the opposite side of the speaker cabinet such that in response to excursion of a driver of the loudspeaker system in a first direction said at least one first flexible pad undergoes further compression and said at least one second flexible pad is extended.

18. The method of claim 16 in which step (c) comprises affixing at least one first flexible pad to one side of the speaker cabinet and affixing at least one second flexible pad to the opposite side of the speaker cabinet such that in response to excursion of a driver of the loudspeaker system in a second direction said at least one first flexible pad is extended and said at least one second flexible pad undergoes further compression.

19. The method of claim 12 in which step (c) comprises affixing a number of first flexible pads at spaced locations along one side of the speaker cabinet and affixing a number of second flexible pads at spaced locations along the opposite side of the speaker cabinet.

20. Apparatus for mounting a loudspeaker system including a speaker cabinet having a top wall, a front wall and a back wall within a cavity in the wall of a room defined by spaced first and second studs each extending between a top plate and a bottom plate, said cavity being enclosed by a first wall section located on one side of the first and second studs and a second wall section located on the opposite side of the first and second studs, said apparatus comprising:

a weight support member mounted to the top plate and to the top wall of the speaker cabinet, said weight support member being effective to suspend the speaker cabinet within the cavity in the wall of the room;

at least one first flexible member extending from the front wall of the speaker cabinet into engagement with the first wall section and at least one second flexible member extending from the back wall of the speaker cabinet into engagement with the second wall section, said at least one first flexible member and said at least one second flexible member being effective to stabilize the position of the speaker cabinet suspended within the cavity from movement in a direction between the first and second studs and in a direction between the first and second wall sections.

21. The apparatus of claim 20 in which said at least one first flexible member comprises a number of first flexible pads mounted at spaced locations to the front wall of the speaker cabinet, and said at least one second flexible member comprises a number of second flexible pads mounted at spaced locations to the back wall of the speaker cabinet.

22. The apparatus of claim 21 in which each of said at least one first and second flexible pads is formed of a foam material.

23. The apparatus of claim 21 in which said at least one first flexible pad and said at least one second flexible pad undergo initial compression between the front wall or the back wall of the speaker cabinet and one of the first and second wall sections upon installation of the loudspeaker system within the cavity in the wall of the room.

24. The apparatus of claim 23 in which the loudspeaker system includes a driver mounted within the speaker cabinet which undergoes excursion during operation, said at least one first flexible pad undergoing further compression in response to excursion of the driver in a first direction and said at least one second flexible pad being extended in response to excursion of the driver in said first direction.

25. The apparatus of claim 24 in which said at least one first flexible pad is extended in response to excursion of the driver in a second direction, opposite to said first direction, and said at least one second flexible pad undergoes further compression in response to excursion of the driver in said second direction.

26. A loudspeaker system for mounting within a cavity in the wall of a room defined by spaced first and second studs each extending between a top plate and a bottom plate, said cavity being enclosed by a first wall section located on one side of the first and second studs and a second wall section located on the opposite side of the first and second studs, said loudspeaker system comprising:

a speaker cabinet having a top wall, a bottom wall, a front wall, a back wall and opposed end walls;

a driver mounted within said speaker cabinet, said driver undergoing excursion during operation in a first direction and in an opposite, second direction;

a weight support member connected between the top plate and said top wall of said speaker cabinet or between the bottom plate and said bottom wall of said speaker cabinet, said weight support member being effective to support said speaker cabinet within the cavity in the wall of the room;

at least one first flexible member extending from the front wall of the speaker cabinet into engagement with the first wall section and at least one second flexible member extending from the back wall of the speaker cabinet into engagement with the second wall section, said at least one first flexible member and said at least one second flexible member being effective to collectively stabilize the position of the speaker cabinet within the cavity from movement in a direction between the first and second studs and in a direction between the first and second wall sections.

27. The loudspeaker system of claim 26 in which said weight support member comprises a tension device connected between the top plate and said top wall of said speaker cabinet.

28. The loudspeaker system of claim 27 in which said tension device is chosen from the group consisting of a rod, spring, rope, cable, cord, bungee cord and rubber band.

29. The loudspeaker system of claim 26 in which said weight support member comprises:

a first bracket mounted to the top plate;

a second bracket mounted to said top wall of said speaker cabinet;

a rod having a first resilient body connected at one end and a second resilient body connected at its opposite end, said first resilient body being coupled to said first bracket and said second resilient body being coupled to said second bracket.

30. The loudspeaker system of claim 26 in which said weight support member is a compression device connected between the bottom plate and said bottom wall of said speaker cabinet.

31. The loudspeaker system of claim 26 in which said at least one first flexible member comprises a number of first flexible pads mounted at spaced locations to the front wall of the speaker cabinet, and said at least one second flexible member comprises a number of second flexible pads mounted at spaced locations to the back wall of the speaker cabinet.

32. The loudspeaker system of claim 26 in which each of said at least one first and second flexible members is formed of a foam material.

33. The loudspeaker system of claim 26 in which said at least one first flexible member and said at least one second flexible member undergo initial compression between said front wall or said back wall of said speaker cabinet and one of the first and second wall sections upon installation of said speaker cabinet within the cavity in the wall of the room.

34. The apparatus of claim 33 in which said at least one first flexible member undergoes further compression in response to excursion of the driver in said first direction and said at least one second flexible member is extended in response to excursion of the driver in said first direction.

35. The apparatus of claim 34 in which said at least one first flexible member is extended in response to excursion of said driver in said second direction, and said at least one second flexible member undergoes further compression in response to excursion of the driver in said second direction.

* * * * *